US010703104B2

(12) United States Patent
Nakamura et al.

(10) Patent No.: US 10,703,104 B2
(45) Date of Patent: Jul. 7, 2020

(54) LIQUID EJECTING APPARATUS

(71) Applicant: SEIKO EPSON CORPORATION, Tokyo (JP)

(72) Inventors: Hiroyuki Nakamura, Shiojiri (JP); Hiroki Chino, Matsumoto (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/214,353

(22) Filed: Dec. 10, 2018

(65) Prior Publication Data

US 2019/0176474 A1 Jun. 13, 2019

(30) Foreign Application Priority Data

Dec. 11, 2017 (JP) ..... 2017-236662

(51) Int. Cl.

| | |
|---|---|
| ***B41J 2/17*** | (2006.01) |
| ***B41J 2/175*** | (2006.01) |
| ***B41J 2/045*** | (2006.01) |
| ***B41J 2/185*** | (2006.01) |
| ***B41J 2/195*** | (2006.01) |
| ***B41J 29/377*** | (2006.01) |

(52) U.S. Cl.

CPC ..... *B41J 2/1721* (2013.01); *B41J 2/175* (2013.01); *B41J 2/185* (2013.01); *B41J 2/195* (2013.01); *B41J 29/377* (2013.01); *B41J 2002/1856* (2013.01)

(58) Field of Classification Search

CPC ..... B41J 2/1721; B41J 2/04566; B41J 2/175
See application file for complete search history.

(56) References Cited

U.S. PATENT DOCUMENTS

| | | | | |
|---|---|---|---|---|
| 7,918,532 | B2 | 4/2011 | Shimazaki et al. | |
| 8,360,551 | B2 | 1/2013 | Kagata et al. | |
| 2010/0066771 | A1 | 3/2010 | Hiratsuka et al. | |
| 2012/0105540 | A1 | 5/2012 | Kondo | |
| 2012/0139989 | A1 | 6/2012 | Ohtsu et al. | |
| 2012/0194604 | A1* | 8/2012 | Tamaki | B41J 2/165 347/22 |
| 2012/0249675 | A1* | 10/2012 | Loyd | B41J 2/16532 347/36 |

FOREIGN PATENT DOCUMENTS

| | | | |
|---|---|---|---|
| EP | 1702760 | A | 9/2006 |
| EP | 2481589 | A | 8/2012 |
| JP | H03-075152 | A | 3/1991 |
| JP | 2005-138463 | A | 6/2005 |

(Continued)

OTHER PUBLICATIONS

European Search Report issued in Application No. 18211730 dated Apr. 16, 2019.

*Primary Examiner* — Jason S Uhlenhake
(74) *Attorney, Agent, or Firm* — Workman Nydegger

(57) ABSTRACT

A liquid ejecting apparatus includes: an ejection portion that ejects liquid onto a medium; a waste liquid container having a container that is configured to store a waste liquid discharged from the ejection portion; a housing that houses the ejection portion; and a humidity adjustment portion that adjusts humidity inside the housing. The waste liquid container is configured to store moisture discharged from the humidity adjustment portion.

19 Claims, 4 Drawing Sheets

(56) References Cited

FOREIGN PATENT DOCUMENTS

| | | | |
|---|---|---|---|
| JP | 2005212138 | A | 8/2005 |
| JP | 2007290251 | A | 11/2007 |
| JP | 2010-069673 | A | 4/2010 |
| JP | 2011183775 | A | 9/2011 |
| JP | 2012-116179 | A | 6/2012 |
| JP | 2012158073 | A | 8/2012 |
| JP | 2017052136 | A | 3/2017 |

* cited by examiner

LIQUID EJECTING APPARATUS

BACKGROUND

1. Technical Field

The present invention relates to liquid ejecting apparatuses that include an ejection portion for ejecting liquid onto a medium such as a paper sheet.

2. Related Art

As an example of such liquid ejecting apparatuses, ink jet printers that perform printing on a medium such as a paper sheet by ejecting ink (an example of the liquid) from a plurality of nozzles of an ejection head (an example of the ejection portion) have been widely known. These printers are provided with a maintenance unit that performs maintenance such as cleaning by which liquid is forcibly discharged from the nozzles of the ejection head. The liquid discharged from the ejection head by the maintenance unit is stored in a waste liquid container via a waste liquid flow path. In the printer, however, paper creases or curls may occur depending on the state of the paper sheet before printing.

In order to prevent curls of media, there is disclosed a liquid ejecting apparatus (ink jet recording apparatus) which includes a dehumidification portion for dehumidifying a storage portion in which media are stored. JP-A-2012-116179 is an example of related art. In the dehumidification portion, a dehumidification agent such as silica gel is used.

The liquid ejecting apparatus described in JP-A-2012-116179 uses a dehumidification agent as the dehumidification portion. However, when an electric dehumidification unit that is electrically driven to perform dehumidification is used as the dehumidification portion, moisture is generated during dehumidification for humidity adjustment, and the generated moisture needs to be processed. In the liquid ejecting apparatus disclosed in JP-A-2012-116179, a processing of water does not need to be considered since the dehumidification portion is a dehumidification agent that absorbs moisture. For example, if an electric type dehumidification portion is used, providing an apparatus dedicated to water processing may lead to a large-sized or complicated liquid ejecting apparatus. On the other hand, in the maintenance unit, there may be disadvantages caused by drying of liquid (waste liquid) generated by maintenance such as failure in smooth cleaning due to sticking of liquid in the waste liquid flow path and a decrease in processing efficiency of waste liquid in the waste liquid container due to a dried solid substance of liquid.

SUMMARY

An advantage of some aspect of the invention is that a liquid ejecting apparatus that enables humidity adjustment inside the housing and a decrease of disadvantages caused by drying of liquid discharged from the ejection portion and received in the waste liquid container with a simple configuration is provided.

In the following description, means for solving the above problem and the advantageous effect thereof will be described. A liquid ejecting apparatus for solving the above problem includes: an ejection portion that ejects liquid onto a medium; a waste liquid container having a container that is configured to store a waste liquid discharged from the ejection portion; a housing that houses the ejection portion; and a humidity adjustment portion that adjusts humidity inside the housing, wherein the waste liquid container is configured to store moisture discharged from the humidity adjustment portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

With reference to the drawings, an embodiment of a liquid ejecting apparatus will be described. A liquid ejecting apparatus 10 of the present embodiment is an ink jet printer that performs recording (printing) by ejecting ink, which is an example of liquid, onto a medium S such as a paper sheet which is transported in a transport direction Y that crosses (in this embodiment, perpendicular to) an ejection direction Z of the liquid.

Figure 1:
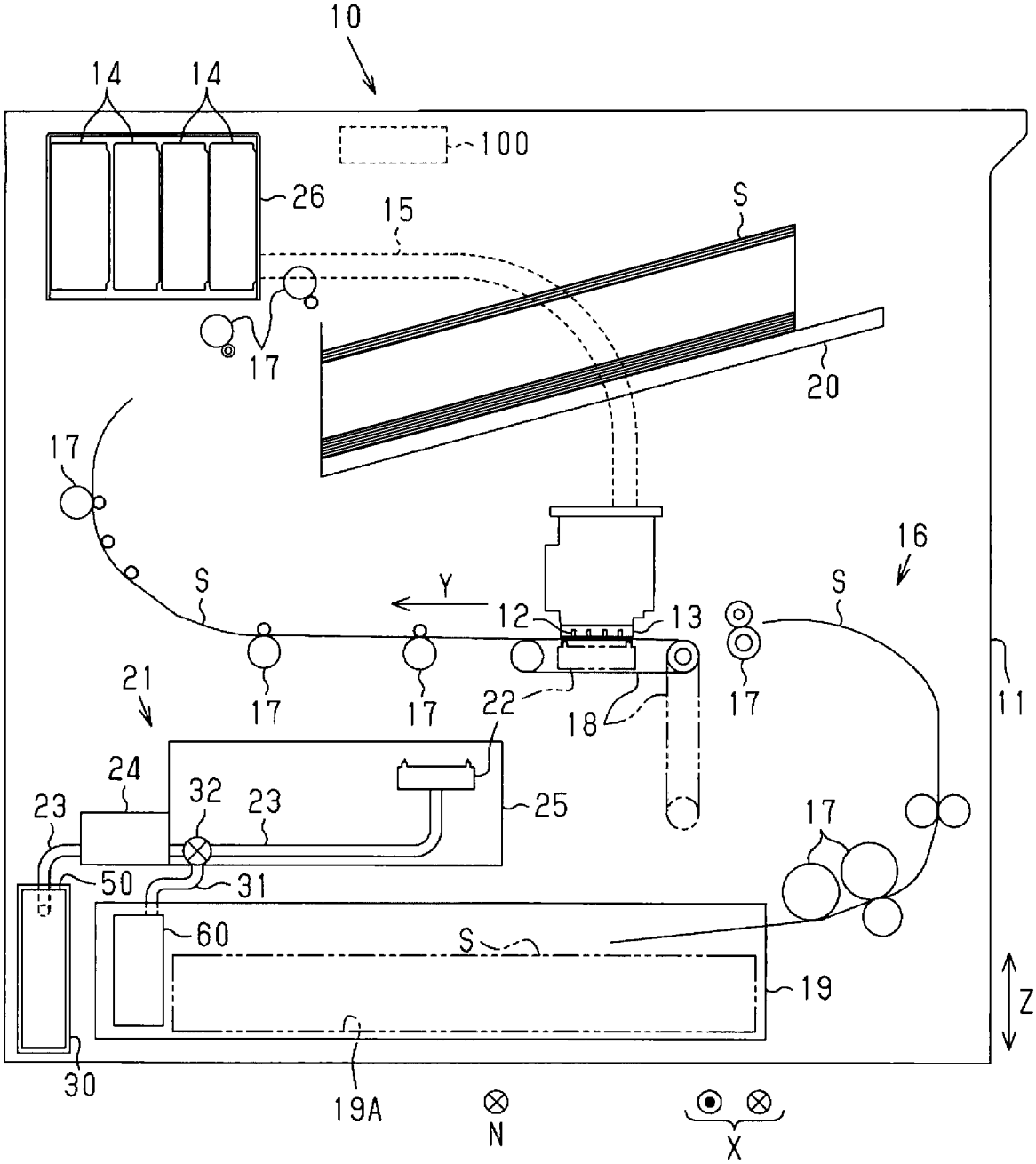
FIG. 1 is a schematic front cross-sectional view of a liquid ejecting apparatus according to a first embodiment.

As shown in FIG. 1, the liquid ejecting apparatus 10 shown in FIG. 1 includes a housing 11 having a substantially cuboid shape. The liquid ejecting apparatus 10 includes an ejection head 13, which is an example of an ejection portion having one or more nozzles 12 which are open for ejecting liquid droplets, a transport unit 16 for transporting the medium S, and a control unit 100 for controlling these components, which are disposed in the housing 11. The ejection head 13 is connected to a supply flow path 15 so that liquid supplied from a liquid supply source 14 flows therethrough to the ejection head 13. When a position at which the ejection head 13 ejects liquid is defined as a recording position, the transport unit 16 includes a plurality of transport rollers 17 for transporting the medium S along a transport path which passes by the recording position, and a transport belt 18 that transports the medium S at the recording position. Here, the transport direction Y refers to a transport direction of the medium S in the recording position. Further, the liquid ejecting apparatus 10 may be a multi-function machine provided with an image reader and an auto feeder disposed vertically above the apparatus.

The ejection head 13 ejects liquid onto the medium S. The ejection head 13 of the present embodiment is a line head that can eject liquid across the entire width of the medium S in a width direction X, which crosses (in this embodiment, perpendicular to) the transport direction Y and the ejection direction Z.

The liquid supply source 14 may be, for example, a cartridge type liquid container that is detachably mounted on a holder 26 for the supply source, which is provided in the liquid ejecting apparatus 10. Alternatively, the liquid supply source 14 may be configured to be refilled with liquid by pouring liquid into a liquid tank mounted on the holder 26.

The liquid ejecting apparatus 10 includes a cassette 19, which is an example of an accommodating portion that can accommodate a plurality of media S before printing, a loading tray 20 on which the printed media S outputted outside the housing 11 are stacked, a maintenance unit 21 that performs maintenance of the ejection head 13, and a waste liquid container 50 for storing waste liquid generated during maintenance or the like of the ejection head 13. The waste liquid container 50 is positioned at a predetermined position in the housing 11 when mounted on the holder 30 for waste liquid. The cassette 19 is detachably attached on the housing 11 when inserted in an insertion direction N into a recess (not shown in the figure) formed in the housing 11. With the cassette 19 inserted in the housing 11 as shown in FIG. 1, the medium S accommodated in the cassette 19 is located in the housing 11.

In order to prevent or eliminate ejection failure caused by clogging of the nozzles 12 or attachment of a foreign substance onto the nozzles 12 of the ejection head 13, the liquid ejecting apparatus 10 performs maintenance operation such as flushing, capping, and suction cleaning. The maintenance unit 21 includes a cap 22, a waste liquid flow path 23 that connects the cap 22 with the holder 30, a suction pump 24 disposed at a position in the middle of the waste liquid flow path 23, and a movement mechanism 25.

The movement mechanism 25 moves the cap 22 between a retracted position indicated by the solid line in FIG. 1 and a capping position that is in contact with the ejection head 13 (indicated by the dot-dot-dashed line in FIG. 1). Further, when the cap 22 moves to the capping position, the transport belt 18 is retracted from a support position indicated by the solid line in FIG. 1 to a retracted position indicated by the dot-dot-dashed line in FIG. 1.

When the cap 22 moves to the capping position to be in contact with the ejection head 13 and surround the nozzles 12, capping is ready to be performed. During the period in which liquid ejection is not performed, capping is performed to prevent drying of the nozzles 12 to thereby prevent occurrence of ejection failure.

Flushing is an operation to forcibly eject (discharge) liquid droplets from the nozzles 12 independently from printing operation to thereby discharge foreign substance that causes ejection failure, air bubble or thickened ink. The liquid discharged as waste liquid by flushing may be received by the cap 22, or a flushing box separately provided to receive waste liquid discharged by flushing. In the latter case, liquid collected in the flushing box is discharged into the waste liquid container 50 via a tube by actuating a pump (the tube and the pump are not shown in the figure) on a regular or irregular basis.

Further, when the suction pump 24 is actuated with the cap 22 being positioned at the capping position to thereby cause negative pressure in the nozzles 12, suction cleaning is performed by the negative pressure to suction and discharge liquid from the nozzles 12. The waste liquid flow path 23 has one end connected to the cap 22 and the other end connected to the holder 30 via the suction pump 24 and thus communicating with the waste liquid container 50 via the holder 30. The waste liquid container 50 includes a container 51 that can store liquid discharged from the ejection head 13.

The liquid discharged from the nozzles 12 by cleaning is stored as waste liquid in the waste liquid container 50 via the waste liquid flow path 23 connected to the cap 22. Further, when the cap 22 is configured to receive the waste liquid discharge by flushing, the liquid received by the cap 22 is stored in the waste liquid container 50 via the waste liquid flow path 23 by actuating the suction pump 24 while the cap 22 is separated from the ejection head 13.

As shown in FIG. 1, the waste liquid container 50 is positioned, for example, on the lateral side of the cassette 19. The waste liquid container 50 is inserted from an insertion port by opening a cover which is provided on the front side when viewed facing the sheet of FIG. 1 (the insertion port and the cover are not shown in the figure) into the back side of the housing 11. The insertion direction is the width direction X. The waste liquid container 50 has, for example, a cuboid shape elongated in one direction, and is inserted such that the longitudinal direction is taken as the width direction X. In this example, the holder 30 is positioned in the housing 11 on the back side in the insertion direction of the waste liquid container 50. The holder 30 is connected to a downstream end of the waste liquid flow path 23. In the state where the waste liquid container 50 is mounted on the holder 30, the waste liquid flow path 23 is connected such that it can discharge waste liquid into the waste liquid container 50 via the holder 30.

Further, as shown in FIG. 1, the liquid ejecting apparatus 10 includes a humidity adjustment portion 60 for adjusting humidity in the housing 11. The humidity adjustment portion 60 has at least one of a dehumidifying function of dehumidifying inside the housing 11 and a humidifying function of humidifying inside the housing 11. Accordingly, the humidity adjustment portion 60 includes at least one of a dehumidification portion that dehumidifies inside the housing 11 and a humidification portion that humidifies inside the housing 11.

In the present embodiment, the humidity adjustment portion 60 is provided in the housing 11 at a position adjacent to the cassette 19 or in the cassette 19. In the example shown in FIG. 1, the humidity adjustment portion 60 is positioned on the back side relative to the medium accommodating area 19A where the medium S is accommodated in the cassette 19 (on the back side in the direction perpendicular to the sheet of FIG. 1) in the insertion direction N. The humidity adjustment portion 60 is provided in the housing 11 at a position close to the waste liquid container 50 (in FIG. 1, a leftward position).

The humidity adjustment portion 60 adjusts humidity in the housing 11, particularly in the cassette 19, to reduce creases and curls of the medium S accommodated in the cassette 19 before printing. For this reason, it is preferred that, in the state where the cassette 19 is inserted, a humidity adjustment target area of the cassette 19 including at least the medium accommodating area 19A is substantially closed so that inflow and outflow of air is prevented between the humidity adjustment target area and the remaining portion of the housing 11. The humidity adjustment portion 60, if having a dehumidification portion that dehumidifies inside the housing 11, stores moisture generated by dehumidification. Further, the humidity adjustment portion 60, if having a humidification portion that humidifies inside the housing 11, stores moisture to be used for dehumidification. Part of the moisture stored in the humidity adjustment portion 60 is discharged into the waste liquid container 50. Accordingly, the waste liquid container 50 is configured to store moisture discharged from the humidity adjustment portion 60. In this embodiment, a moisture flow path 31 which extends from the humidity adjustment portion 60 to discharge moisture is connected to a position in the middle of the waste liquid flow path 23. In other words, the moisture flow path 31 has one end connected to the humidity adjustment portion 60, and the other end connected to a position in the middle of the waste liquid flow path 23. The moisture flow path 31 joins the waste liquid flow path 23 at a position on the upstream side where the cap 22 is located relative to the suction pump 24 in the waste liquid flow path 23. In other words, moisture from the humidity adjustment portion 60 is stored in the waste liquid container 50 via the moisture flow path 31 and the waste liquid flow path 23. In the moisture flow path 31, a solenoid valve 32, which is an example of an open-close valve for opening and closing the moisture flow path 31, is provided at a predetermined position before the joining point with the waste liquid flow path 23. In the example shown in FIG. 1, the solenoid valve 32 is provided at a joining point between the moisture flow path 31 and the waste liquid flow path 23, and is composed of a flow path switching valve that switches a flow path communicating with the suction pump 24 between the waste liquid flow path 23 and the moisture flow path 31.

The solenoid valve 32 is controlled by the control unit 100. During cleaning, the solenoid valve 32 is controlled to be located at a first switching position where communication between the suction pump 24 and the cap 22 is allowed and communication between the suction pump 24 and the humidity adjustment portion 60 is blocked. Further, during discharge of moisture or water from the humidity adjustment portion 60, the solenoid valve 32 is controlled to be located at a second switching position where communication between the suction pump 24 and the cap 22 is blocked and communication between the suction pump 24 and the humidity adjustment portion 60 is allowed. When neither cleaning nor moisture discharge is performed, the solenoid valve 32 may be located at any position. However, the solenoid valve 32 is preferably at the first switching position in order to prevent liquid remaining in the waste liquid flow path 23 from flowing into the moisture flow path 31. Furthermore, the solenoid valve 32 may also be composed of an open-close valve disposed at a position in the middle of the moisture flow path 31.

Figure 2:
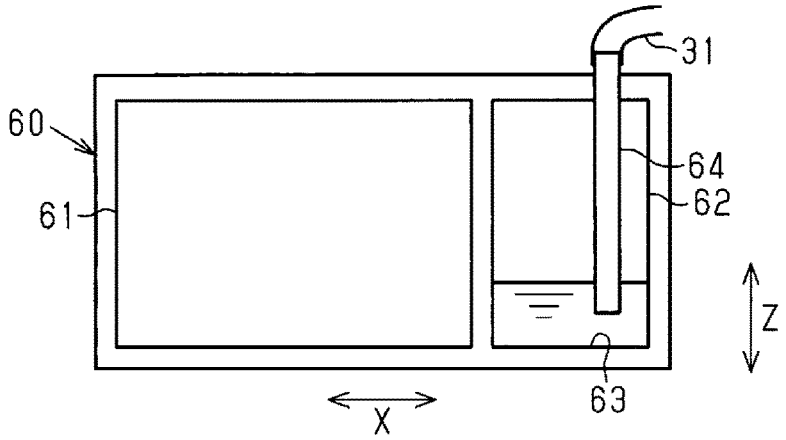
FIG. 2 is a schematic cross-sectional view of a humidity adjustment portion.

Next, referring to FIG. 2, the configuration of the humidity adjustment portion 60 will be described. As shown in FIG. 2, the humidity adjustment portion 60 includes a humidity adjustment driving portion 61, and a reservoir 62 for storing water. The reservoir 62 is connected to one end of the moisture flow path 31. The reservoir 62 includes a discharge tube 64 having an end connected to one end of the moisture flow path 31. The other end of the discharge tube 64 extending in the reservoir 62 has an opening located at a predetermined height in the vertical direction Z from an inner bottom of the reserving chamber 63 in the reservoir 62. Depending on the vertical position between the water level in the reservoir 62 and the opening at the other end of the discharge tube 64, moisture (water or humid air) is discharged from the reservoir 62 into the moisture flow path 31 via the discharge tube 64. Further, the humidity adjustment driving portion 61 and the reservoir 62 are connected to each other via a flow path, which is not shown in the figure.

Further, in the case where the humidity adjustment portion 60 is a dehumidification portion, the humidity adjustment driving portion 61 is a dehumidification driving portion, and the reservoir 62 stores water generated by dehumidification by the dehumidification driving portion. The dehumidification driving portion, which is a humidity adjustment driving portion 61, generates water during dehumidification. The dehumidification driving portion may be of any type such as compressor type, desiccant type, Peltier type that uses an electronic cooling element (Peltier element), and electrolysis type that performs dehumidification accompanying electrolysis of humidity using a solid polymer electrolyte.

Further, in the case where the humidity adjustment portion 60 is a humidification portion, the humidity adjustment driving portion 61 is a humidification driving portion, and the reservoir 62 stores water discharged by a user for use in humidification by the humidification driving portion. The humidification driving portion, which is a humidity adjustment driving portion 61, performs humidification by using water stored in the reservoir 62. The humidification driving portion may be of any type such as steam type, vaporization type, ultrasonic type, and electrolysis type that performs humidification accompanying electrolysis of water using a solid polymer electrolyte.

Moreover, in the case where the humidity adjustment portion 60 has both dehumidifying function and humidifying function, the humidity adjustment driving portion 61 is a driving portion that performs both dehumidification and humidification, and the reservoir 62 stores moisture generated by dehumidification and water discharged by a user for use in humidification. In this case, the driving portion may separately include the dehumidification driving portion and the humidification driving portion, or may include a single driving portion having both the dehumidifying function and the humidifying function. In the latter case, for example, an electrolysis type is used for the humidity adjustment driving portion 61. Further, the moisture is not limited to water, and may also include humid air generated by dehumidification or humid air which is present in a space above the water level in the reservoir 62 which stores water to be used for humidification.

Figure 3:
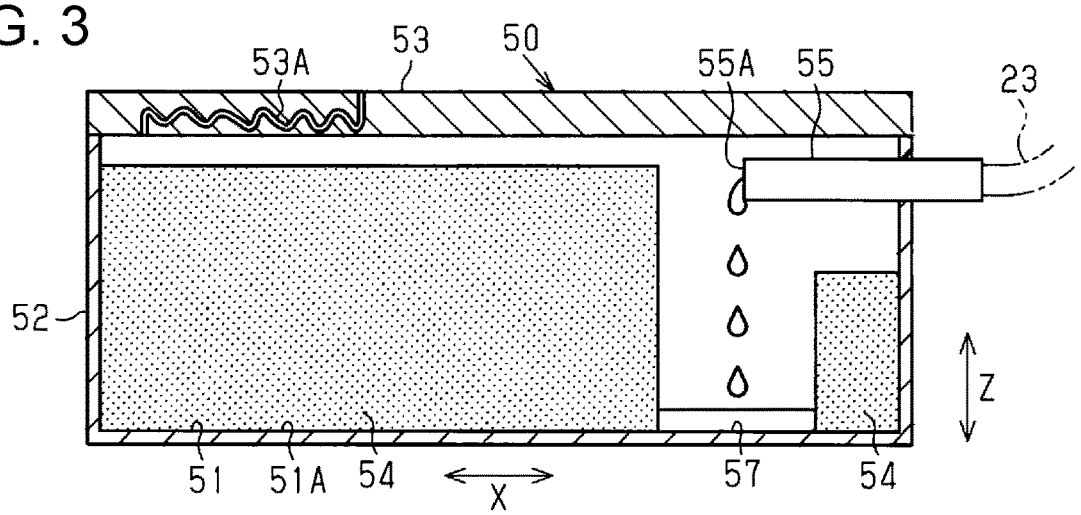
FIG. 3 is a schematic side cross-sectional view of a waste liquid container.

Next, referring to FIG. 3, the waste liquid container 50 will be described. As shown in FIG. 3, the waste liquid container 50 includes the container 51 that can store liquid. The waste liquid container 50 includes a cuboid vessel 52 having an opening at an upper end, and a lid 53 that closes the opening of the vessel 52. The container 51 is composed of a substantially closed inner space which is formed by the vessel 52 and the lid 53 joined to the upper end of the vessel 52. In the container 51 of the waste liquid container 50, an absorbent member 54 that can absorb liquid (for example, ink) and water is provided. The waste liquid container 50 includes a waste liquid discharge portion 55 that discharges liquid. An outer end of the waste liquid discharge portion 55 is connected to the other end (downstream end) of the waste liquid flow path 23. From an introduction port 55A of the waste liquid discharge portion 55, liquid and moisture are discharged into the container 51. Further, the waste liquid container 50 includes a receiving portion 57 that receives liquid and moisture discharged from the waste liquid discharge portion 55. As shown in FIG. 3, the receiving portion 57 is formed of a region where the absorbent member 54 is not provided in the container 51.

Further, the waste liquid discharge portion 55 may be a flow path member provided in the waste liquid container 50 and is connected to a flow path of the holder 30 when the waste liquid container 50 is inserted, or may be a flow path member provided in the holder 30 and is inserted into the waste liquid container 50 via a liquid leakage prevention valve, which is not shown in the figure, when the waste liquid container 50 is inserted into the holder 30. Thus, the waste liquid discharge portion 55 may be either part of the waste liquid container 50 or part of the holder 30. Accordingly, FIG. 3 does not illustrate the holder 30 and schematically shows that the outer end of the waste liquid discharge portion 55 communicates with the waste liquid flow path 23.

The waste liquid container 50 includes an atmosphere communication portion 53A that allows communication between the inside and outside. In the example shown in FIG. 3, the atmosphere communication portion 53A is formed in the lid 53. At least part of the atmosphere communication portion 53A may be formed as a narrow tube structure (meandering structure). The meandering structure refers to a tubular structure of a complicated path having a narrow and meandering tubular path that allows inflow and outflow of air but restricts inflow and outflow of liquid to a great extent. Accordingly, outflow of moisture from the waste liquid container 50 into the housing 11 via the atmosphere communication portion 53A is reduced.

Figure 4:
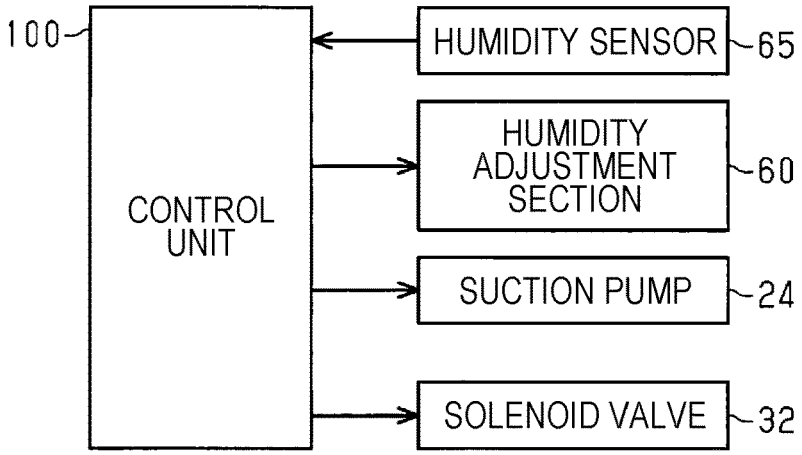
FIG. 4 is a block diagram which illustrates an electric configuration of a portion related to cleaning and humidity adjustment.

Next, referring to FIG. 4, an electric configuration of a portion of the liquid ejecting apparatus 10 related to cleaning and humidity adjustment will be described. As shown in FIG. 3, the control unit 100 which integrally controls the liquid ejecting apparatus 10 is electrically connected to a humidity sensor 65, the humidity adjustment portion 60, the suction pump 24 and the solenoid valve 32. Further, the control unit 100 is also electrically connected to the ejection head 13, the transport unit 16 and the movement mechanism 25. Specifically, the transport unit 16 and the movement mechanism 25 each include an electric motor as a driving source, and these electric motors are electrically connected to the control unit 100 via the respective motor driving circuits (the electric motor and the motor driving circuit are not shown in the figure).

The humidity sensor 65 detects humidity inside the housing 11. In the present embodiment, the humidity sensor 65 particularly detects humidity inside the cassette 19. The control unit 100 drives and controls the humidity adjustment portion 60 on the basis of a detection signal from the humidity sensor 65 so that humidity inside the housing 11 becomes the value within a setting range to thereby adjust humidity inside the housing 11 including the cassette 19. That is, the control unit 100 drives the humidity adjustment portion 60 when the detected humidity based on the detection signal from the humidity sensor 65 falls out of the setting range, and stops the driving of the humidity adjustment portion 60 when the detected humidity falls within the setting range. Further, when the appropriate humidity range for reducing curls of the medium S is different depending on the type of the medium S (for example, type of the paper sheet), the setting range of humidity may be modified depending on the type of the medium S.

Further, on start of cleaning period, the control unit 100 drives the movement mechanism 25 to move the transport belt 18 to a retracted position and moves the cap 22 to the capping position. Then, before performing cleaning, the control unit 100 brings the solenoid valve 32 to the first switching position so that communication between the suction pump 24 and the cap 22 is allowed and communication between the suction pump 24 and the humidity adjustment portion 60 is blocked. In this state, the control unit 100 actuates the suction pump 24 to perform cleaning.

Further, on start of discharging period, the control unit 100 switches the solenoid valve 32 from the first switching position to the second switching position so that communication between the suction pump 24 and the cap 22 via the waste liquid flow path 23 is blocked and communication between the suction pump 24 and the humidity adjustment portion 60 via the moisture flow path 31 is allowed. In this state, the control unit 100 actuates the suction pump 24. In this embodiment, the discharging period includes at least the period after cleaning. The discharging period may be defined as, for example, each time after completion of cleaning. Alternatively, a water gauge sensor for detecting a water volume in the reservoir 62 may be provided so that the discharging period is defined as when the water volume exceeds a predetermined threshold. Further, if only the dehumidifying function is provided, the discharging period may be defined as after completion of cleaning and when the water volume in the reservoir 62 exceeds a predetermined threshold. In these cases, if only the dehumidifying function is provided, the threshold is preferably set as a lower limit that prevents discharging operation from being performed when the water volume in the reservoir 62 is zero, and, if the humidifying function is provided, the threshold is preferably set as a lower limit of the range that can left the water volume necessary for humidification. Further, the discharging period may be at least one of on-time of a power supply for the liquid ejecting apparatus 10 and off-time of a power supply. In particular, in order to prevent liquid from being dried and solidified during off-time of the power supply, the discharging period may preferably include off-time of the power supply.

Next, effects of the liquid ejecting apparatus 10 will be described. During on-time of the power supply for the liquid ejecting apparatus 10, the control unit 100 drives the humidity adjustment portion 60 when the detected humidity based on the detection signal from the humidity sensor 65 falls out of the setting range. Accordingly, the inside of the housing 11 is adjusted at an appropriate humidity. In this embodiment, since the inside of the cassette 19 is particularly adjusted at an appropriate humidity, creases and curls of the medium S in the cassette 19 is reduced. For example, when the detected humidity exceeds an upper limit (threshold) of the setting range, the humidity adjustment portion 60 performs dehumidification. At this time, moisture generated by dehumidification is stored in the reservoir 62. Further, when the detected humidity falls below a lower limit (threshold) of the setting range, the humidity adjustment portion 60 performs humidification. At this time, the water volume in the reservoir 62 decreases by the amount consumed by humidification. Further, when the humidity adjustment portion 60 has one of dehumidifying function and humidifying function, one of the dehumidifying function and humidifying function is performed in response to the detected humidity.

On receiving a print job from a host apparatus (not shown in the figure), the liquid ejecting apparatus 10 starts printing. First, when the control unit 100 drives the transport unit 16, the medium S is fed from the cassette 19 and transported along the transport path. When the medium S reaches the recording position, the control unit 100 drives and controls the ejection head 13 on the basis of the print data included in the print job. As a result, liquid (e.g., ink) is ejected from the ejection head 13 onto the medium S so that an image or the like based on the print data is printed on the medium S. The medium S, which is a print target, is prevented from being creased and curled by virtue of appropriate humidity inside the cassette 19. Accordingly, various problems caused by curls of the medium S are reduced. For example, problems such as jam caused by curls of the medium S, misalignment in printing, and smudges due to the medium S being in contact with the nozzle surface on which the nozzles 12 of the ejection head 13 are open can be prevented.

Moreover, flushing is performed before and after printing or during printing, so that liquid droplets are ejected from the ejection head 13 into the cap 22. If a dedicated flushing box is provided, liquid droplets are ejected from the ejection head 13 into the flushing box. Further, cleaning is performed during the cleaning period. The control unit 100 first drives the movement mechanism 25 to move the transport belt 18 to a retracted position and moves the cap 22 to the capping position. Further, before performing cleaning, the control unit 100 brings the solenoid valve 32 to the first switching position so that communication between the suction pump 24 and the cap 22 is allowed and communication between the suction pump 24 and the humidity adjustment portion 60 is blocked. In this state, the control unit 100 actuates the suction pump 24. As the suction pump 24 is actuated, the suction pump 24 suctions air in the cap 22 via the waste liquid flow path 23 and generates negative pressure inside the cap 22 so that liquid is forcibly discharged from the nozzles 12. The liquid discharged into the cap 22 is discharged into the waste liquid container 50 via the waste liquid flow path 23. Since the moisture flow path 31 is blocked during cleaning, cleaning can be appropriately performed while ensuring negative pressure required for the cap 22, and liquid in the cap 22 can be discharged into the waste liquid container 50 via the waste liquid flow path 23 by using a strong discharging force. Further, liquid flowing in the waste liquid flow path 23 during cleaning can be prevented from partially flowing into the humidity adjustment portion 60 via the moisture flow path 31. In the waste liquid container 50, liquid discharged from the waste liquid discharge portion 55 is received in the receiving portion 57.

Furthermore, the control unit 100 performs discharge control during the discharging period in which moisture is discharged from the humidity adjustment portion 60. In this embodiment, the discharging period is set at least at the completion of cleaning. Accordingly, when cleaning is completed, the control unit 100 switches the solenoid valve 32 from the first switching position to the second switching position. As a result, communication between the suction pump 24 and the cap 22 is blocked, and communication between the suction pump 24 and the humidity adjustment portion 60 is allowed. Then, the control unit 100 actuates the suction pump 24. As a result, moisture (for example, water) is discharged by a suction force of the suction pump 24 from the humidity adjustment portion 60 into the waste liquid container 50 via the moisture flow path 31 and the waste liquid flow path 23. At this time, since the liquid left in the waste liquid flow path 23 is discharged after being mixed with water, the inside of the waste liquid flow path 23 is cleaned.

Further, in the waste liquid container 50, since a dilute solution in which the remaining liquid and water is mixed flows in the waste liquid discharge portion 55, the inside of the waste liquid discharge portion 55 is cleaned by the dilute solution. Accordingly, even if the remaining dilute solution is dried and solidified in the waste liquid discharge portion 55, the solid substance is small in amount. Therefore, clogging of the waste liquid discharge portion 55 due to a solid substance is prevented. Further, water (dilute solution) discharged from the waste liquid discharge portion 55 is received in the same receiving portion 57 as that receives the liquid. As a result, liquid in the receiving portion 57 is mixed with water and diluted. The liquid received in the receiving portion 57 during cleaning and the dilute solution received in the receiving portion 57 during discharging are absorbed when reaching the absorbent member 54.

In the conventional art, since only the liquid is discharged into the waste liquid container 50, liquid in the receiving portion 57 becomes thickened and gradually loses fluidity before all the liquid is absorbed by the absorbent member 54. Accordingly, a dry solid substance made of dried liquid tends to be deposited in the receiving portion 57. Such a deposited substance prevents the liquid discharged from the waste liquid discharge portion 55 from flowing from the receiving portion 57 to the absorbent member 54 and absorbed by the absorbent member 54, and also promotes the growth of the deposited substance in the receiving portion 57. In this case, the absorbent member 54 cannot be effectively used, which results in a decrease in the actual amount of waste liquid stored in the waste liquid container 50.

On the other hand, in the present embodiment, since the liquid in the receiving portion 57 is diluted by being mixed with water (dilute solution), thickening of the liquid requires a time. Accordingly, the liquid is absorbed by the absorbent member 54 before it becomes thickened and loses fluidity. Even if the liquid becomes thickened, it dissolves by the dilute solution which is subsequently discharged, and recovers fluidity and is absorbed by the absorbent member 54. Accordingly, a solid substance does not tend to be deposited in the receiving portion 57 in the waste liquid container 50. Therefore, the absorbent member 54 can be effectively used, ensuring an expected amount of waste liquid stored in the waste liquid container 50.

In the case where the water volume in the reservoir 62 is small and the water level is lower than the lower limit of the discharge tube 64, humid air is fed as moisture from the humidity adjustment portion 60 into the waste liquid flow path 23 via the moisture flow path 31 during the time of discharge control. At this time, part of the remaining liquid in the waste liquid flow path 23 is discharged to the downstream side by a suction air flow. In addition, since the remaining liquid is exposed to moisture in the humid air, drying and solidifying of the remaining liquid can be delayed. As a result, clogging of the waste liquid flow path 23 by a solid substance made of dried and solidified liquid can be avoided.

According to the above embodiment described in detail, the following effects can be obtained.

(1) The liquid ejecting apparatus 10 includes an ejection head 13 that ejects liquid onto the medium S, a waste liquid container 50 having the container 51 that can store liquid discharged from the ejection head 13, the housing 11 that houses the ejection head 13, and the humidity adjustment portion 60 that adjusts humidity inside the housing 11. The waste liquid container 50 is configured to store moisture discharged from the humidity adjustment portion 60. Accordingly, humidity adjustment inside the housing 11 and a decrease of disadvantages caused by the liquid (waste liquid) discharged by maintenance from the ejection head 13 can be achieved with a simple configuration.

(2) The cassette 19 (an example of an accommodating portion) for accommodating the medium S is provided, and the humidity adjustment portion 60 adjusts humidity inside the cassette 19. Accordingly, since humidity inside the cassette 19 for the medium S can be adjusted, curls of the medium S can be effectively reduced.

(3) Liquid is stored in the waste liquid container 50 via the waste liquid flow path 23, and moisture is stored in the waste liquid container 50 via the moisture flow path 31 and the waste liquid flow path 23. Accordingly, moisture discharged from the humidity adjustment portion 60 via the moisture flow path 31 is mixed with liquid left in the waste liquid flow path 23. Accordingly, liquid can be prevented from being dried and solidified in the waste liquid flow path 23. For example, clogging of the waste liquid flow path 23 due to drying and solidifying of liquid can be reduced.

(4) The solenoid valve 32 (an example of open-close valve) for opening and closing the moisture flow path 31 is further provided. Accordingly, the solenoid valve 32 opens the moisture flow path 31 to allow moisture from the humidity adjustment portion 60 to be discharged into the waste liquid container 50 via the moisture flow path 31 and the waste liquid flow path 23. Further, the solenoid valve 32 closes the moisture flow path 31 to restrict liquid flow into the humidity adjustment portion 60.

(5) In the case where the humidity adjustment portion 60 includes the dehumidification portion, the waste liquid container 50 for storing waste liquid from the ejection head 13 can also be used as a container for water generated by dehumidification. Accordingly, an apparatus for a humidity adjustment system can be simplified, and the liquid ejecting apparatus 10 can be prevented from increasing in size.

(6) In the case where the humidity adjustment portion 60 includes the humidification portion, liquid left in the waste liquid flow path 23 can be mixed with moisture by using part of water to be used for humidification. In addition, part of water to be used for humidification can be discharged into the waste liquid container 50 to thereby reduce disadvantages caused by drying of liquid in the waste liquid container 50, for example, deposition of a solid substance made of dried liquid (waste liquid).

(7) Since the atmosphere communication portion 53A partially has a narrow tube structure, humidity in the waste liquid container 50 is prevented from being released outside. Accordingly, the inside of the housing 11 can be maintained at an appropriate humidity in a stable manner.

Second Embodiment

Next, referring to FIGS. 5 to 8, a second embodiment will be described. A basic configuration related to recording of the liquid ejecting apparatus 10 shown in FIG. 5 is the same as that of the first embodiment except for the configuration of an apparatus for a discharge system including a moisture flow path for discharging moisture from the humidity adjustment portion 60 and the waste liquid container 50.

Figure 5:
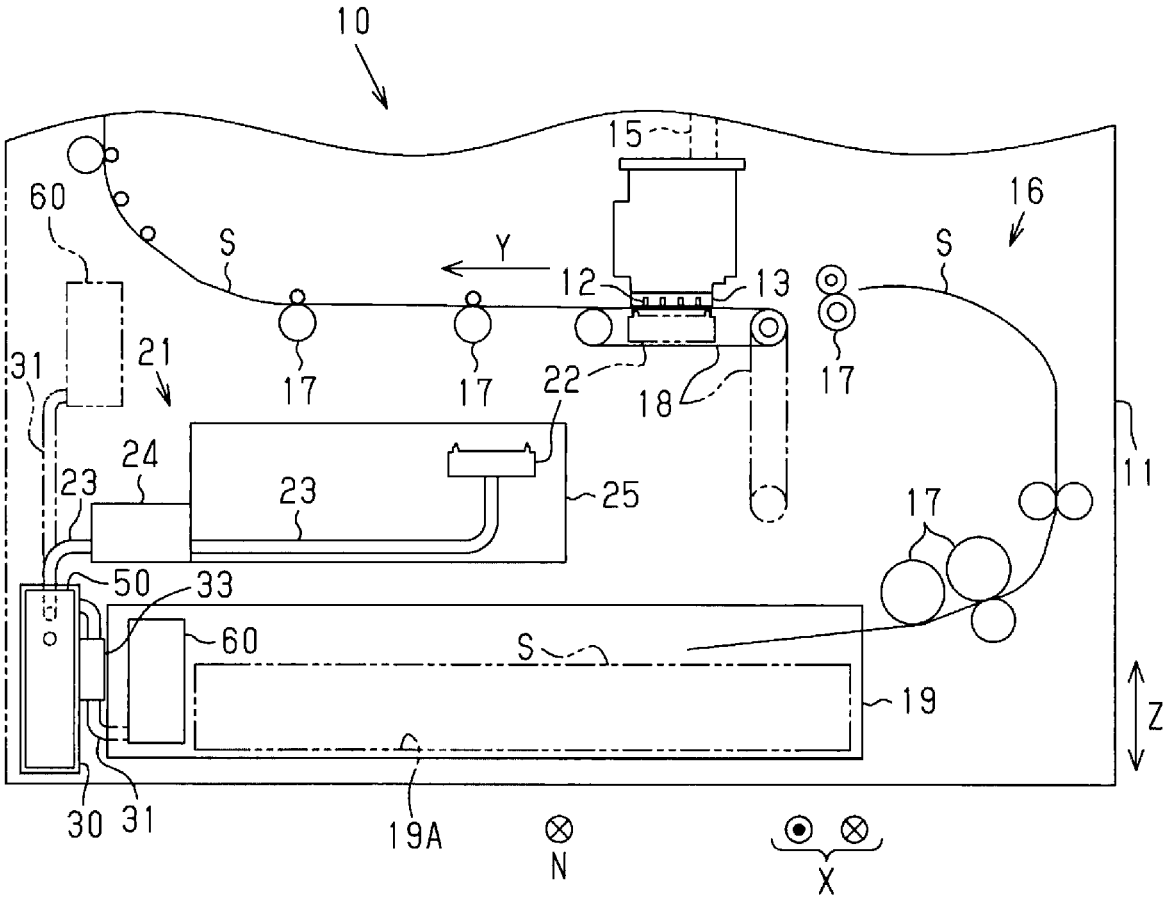
FIG. 5 is a schematic front cross-sectional view of an essential part of a liquid ejecting apparatus according to a second embodiment.

As shown in FIG. 5, the humidity adjustment portion 60 is provided in the housing 11 at a position adjacent to the cassette 19 or in the cassette 19 as with the first embodiment. In the present embodiment, the humidity adjustment portion 60 and the waste liquid container 50 are connected to each other via the moisture flow path 31. A pump 33 is provided at a position in the middle of the moisture flow path 31. When the pump 33 is actuated by the control unit 100, moisture discharged from the humidity adjustment portion 60 is stored in the waste liquid container 50 via the moisture flow path 31. A configuration of the humidity adjustment portion 60 is the same as that of the first embodiment shown in FIG. 2, and includes the humidity adjustment driving portion 61 and the reservoir 62. The moisture flow path 31 has one end connected to the discharge tube 64 (see FIG. 2) inserted into the reservoir 62 and the other end connected to the holder 30 and thus communicating with the waste liquid container 50 via the holder 30. Further, the humidity adjustment portion 60 may be positioned above the maintenance unit 21 in the housing 11 as indicated by the dot-dot-dashed line in FIG. 5. In this case, when an open-close valve, which is not shown, provided at a position in the middle of the moisture flow path 31 indicated by FIG. 5 is opened, water in the reservoir 62 (see FIG. 2) of the humidity adjustment portion 60 is discharged by head difference from the reservoir 62 via the moisture flow path 31 and stored in the waste liquid container 50. In this case, since the inside of the housing 11 can be maintained at an appropriate humidity by the humidity adjustment portion 60, creases and curls of the medium S in the cassette 19 is reduced. Preferably, the humidity adjustment target area by the humidity adjustment portion 60 in the housing 11 is a substantially closed space so that inflow and outflow of air is prevented between the humidity adjustment target area and the outside of the housing 11 at least except for during printing.

As shown in FIG. 5, the waste liquid container 50 communicates with the holder 30 via the waste liquid flow path 23 and the moisture flow path 31. The waste liquid container 50 of the present embodiment has any of the configuration shown in FIG. 6, the configuration shown in FIG. 7, and the configuration shown in FIGS. 8 and 9. These configurations will now be described one by one.

Figure 6:
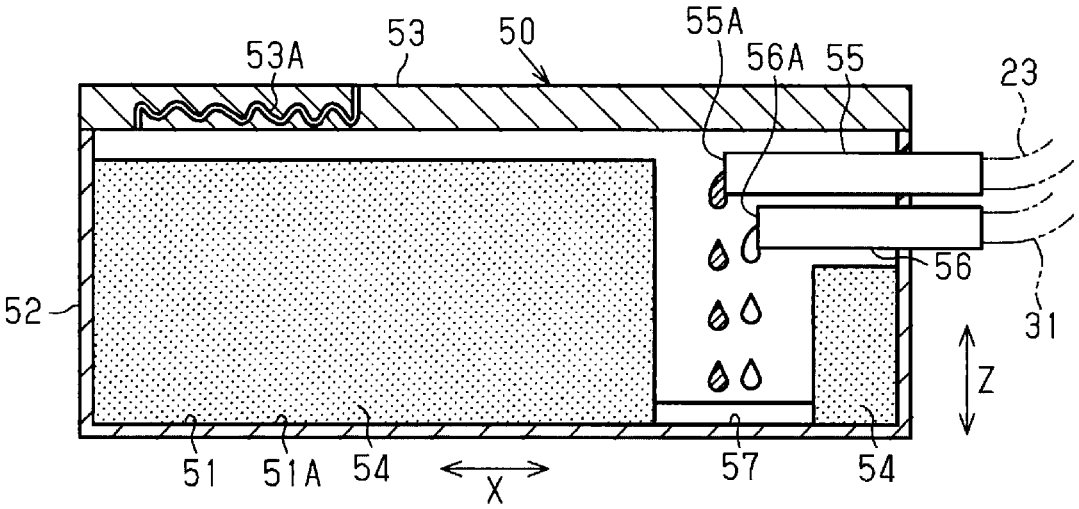
FIG. 6 is a schematic side cross-sectional view of a waste liquid container.

As shown in FIG. 6, the absorbent member 54 that can absorb liquid and moisture is provided in the container 51 of the waste liquid container 50. The waste liquid container 50 includes the waste liquid discharge portion 55 that discharges liquid (for example, ink) and a moisture discharge portion 56 that discharges moisture. The waste liquid discharge portion 55 and the moisture discharge portion 56 are configured such that liquid discharged from the waste liquid discharge portion 55 and moisture discharged from the moisture discharge portion 56 are discharged at a relatively close positions in the container 51. The waste liquid container 50 includes the receiving portion 57 that receives liquid discharged from the waste liquid discharge portion 55. The receiving portion 57 also receives moisture discharged from the moisture discharge portion 56. Accordingly, since liquid is diluted by being mixed with water in the receiving portion 57, the liquid is not likely to be dried and solidified.

Figure 7:
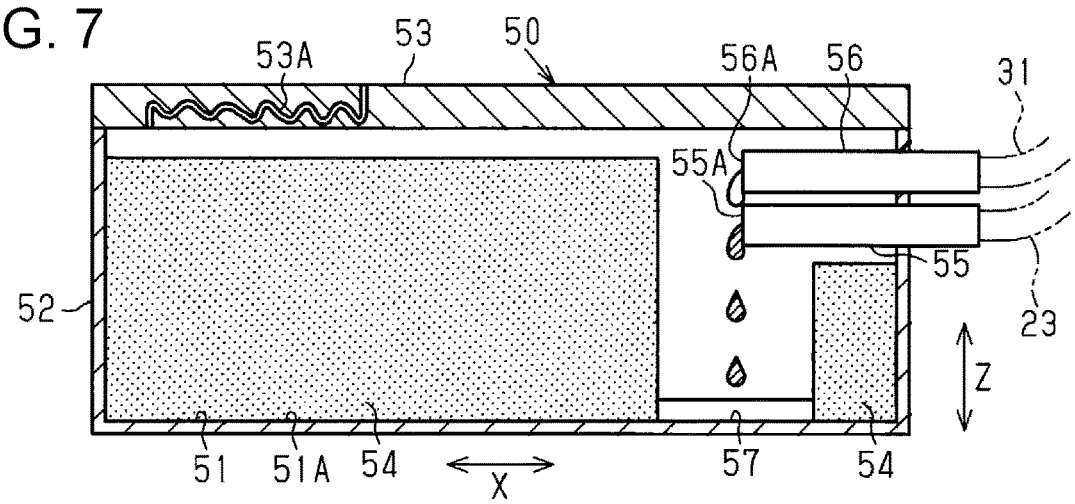
FIG. 7 is a schematic side cross-sectional view of a waste liquid container.

The configuration of the waste liquid container 50 shown in FIG. 7 is substantially the same as the configuration of the waste liquid container 50 shown in FIG. 6, and the absorbent member 54 that can absorb liquid and water is provided in the container 51 of the waste liquid container 50. Further, the waste liquid container 50 includes the waste liquid discharge portion 55 that discharges liquid and the moisture discharge portion 56 that discharges moisture. The waste liquid discharge portion 55 and the moisture discharge portion 56 are located at positions such that a liquid introduction point and a water introduction point are relatively close to each other. Similarly to FIG. 6, the waste liquid container 50 includes the receiving portion 57 that receives liquid discharged from the waste liquid discharge portion 55, and the receiving portion 57 also receives moisture discharged from the moisture discharge portion 56.

In the example shown in FIG. 7, the moisture discharge portion 56 is positioned vertically above the waste liquid discharge portion 55. Accordingly, water flowing or dripping from an introduction port 56A of the moisture discharge portion 56 is attached to the waste liquid discharge portion 55. In other words, water discharged from the moisture discharge portion 56 is directly attached to the introduction port 55A or reaches the introduction port 55A after being attached to the waste liquid discharge portion 55. Then, since liquid and water in the waste liquid discharge portion 55 are mixed with each other at the introduction port 55A, liquid is not likely to be dried and solidified at a position adjacent to the introduction port 55A.

Figure 8:
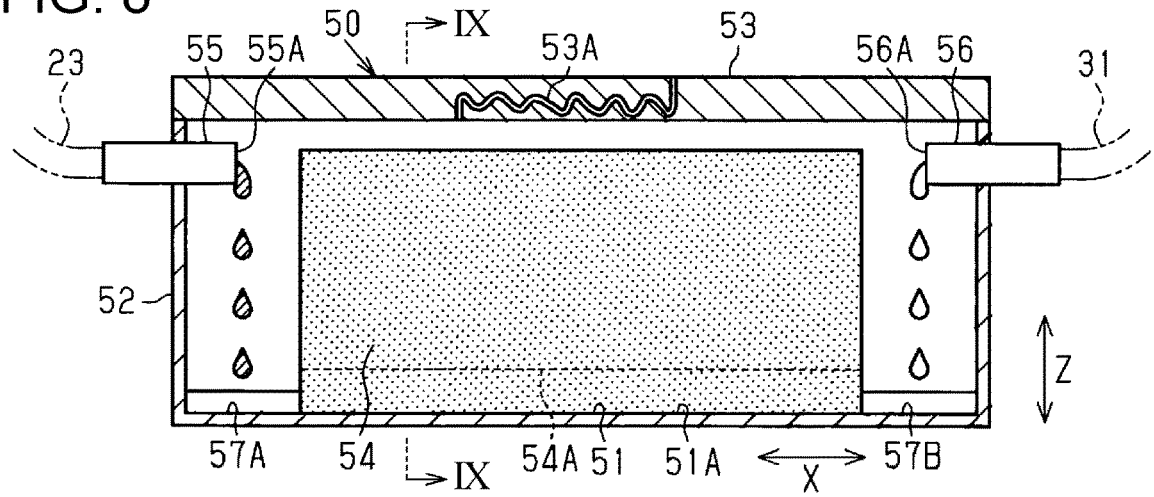
FIG. 8 is a schematic side cross-sectional view of a waste liquid container.
Figure 9:
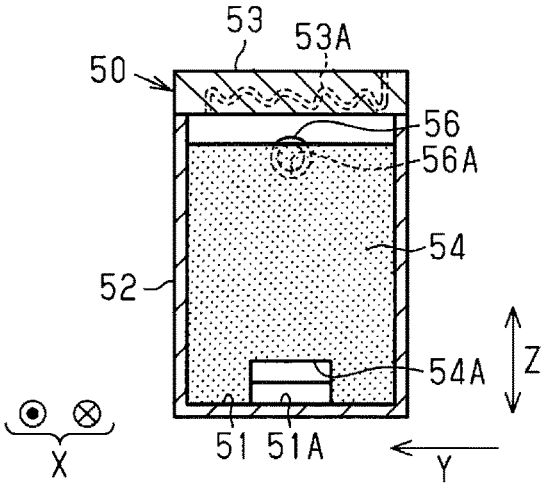
FIG. 9 is a schematic cross-sectional view of a waste liquid container on arrow IX-IX of FIG. 8.

In the examples shown in FIGS. 8 and 9, the waste liquid container 50 includes the waste liquid discharge portion 55 that discharges liquid and the moisture discharge portion 56 that discharges moisture which are disposed, for example, on both sides of the waste liquid container 50 in the longitudinal direction (in FIG. 8, horizontal direction). The absorbent member 54 that can absorb liquid and moisture is provided in the container 51. In the examples shown in FIGS. 8 and 9, the absorbent member 54 is disposed at a substantially center in the longitudinal direction of the container 51, forming a gap between the absorbent member 54 and the respective inner wall surfaces on both sides of the vessel 52 in the longitudinal direction. In the container 51, two receiving portions 57A, 57B are formed by the gap on both sides of the absorbent member 54 in the longitudinal direction. The first receiving portion 57A receives liquid discharged from the introduction port 55A of the waste liquid discharge portion 55. Further, the second receiving portion 57B receives water discharged from the introduction port 56A of the moisture discharge portion 56.

As shown in FIGS. 8 and 9, the absorbent member 54 is provided such that at least part of the absorbent member 54 is not in contact with a bottom 51A of the container 51. For example, a communication portion 54A is formed on the bottom of the absorbent member 54 as a recess extending across the entire length in the longitudinal direction. The absorbent member 54 is not in contact with the bottom 51A at a position of the communication portion 54A. Accordingly, the first receiving portion 57A and the second receiving portion 57B disposed on both sides of the absorbent member 54 in the longitudinal direction in the container 51 communicate with each other via the communication portion 54A. Accordingly, liquid received in the first receiving portion 57A and water received in the second receiving portion 57B are mixed with each other via the communication portion 54A. As a result, liquid can be prevented from being dried and solidified in the first receiving portion 57A.

In any of the configurations of the waste liquid container 50 shown in FIGS. 6 to 9, since liquid received in the receiving portion 57 or the first receiving portion 57A is mixed with moisture, liquid is prevented from being dried and solidified. As a result, a deposited substance is not likely to be generated by dried and solidified liquid in the receiving portions 57 and 57A. Since there is no or little deposited substance, flow of liquid in the receiving portion 57 and 57A toward the absorbent member 54 is not likely to be disturbed, and is easily absorbed by the absorbent member 54.

Further, in FIGS. 6 to 9, the waste liquid discharge portion 55 and the moisture discharge portion 56 may be a flow path member provided in the waste liquid container 50 and is connected to a flow path of the holder 30 when the waste liquid container 50 is inserted, or may be a flow path member provided in the holder 30 and is inserted into the waste liquid container 50 via a liquid leakage prevention valve, which is not shown in the figure, when the waste liquid container 50 is inserted into the holder 30. Thus, the waste liquid discharge portion 55 and the moisture discharge portion 56 may be part of the waste liquid container 50 or part of the holder 30.

According to the second embodiment, the following effects described below as well as the effects (1), (2), and (5) to (7) of the first embodiment are obtained.

(8) According to the configuration shown in FIG. 6, in the waste liquid container 50, the receiving portion 57 that receives liquid discharged from the waste liquid discharge portion 55 also receives moisture discharged from the moisture discharge portion 56. Accordingly, since water is discharged onto the liquid discharged from the waste liquid discharge portion 55 and received in the receiving portion 57, deposition of a solid substance made of dried liquid in the container 51 can be reduced.

(9) In the configuration shown in FIG. 7, the moisture discharge portion 56 for introducing moisture is positioned vertically above the waste liquid discharge portion 55 for introducing liquid. Accordingly, since moisture discharged from the moisture discharge portion 56 is also attached to the waste liquid discharge portion 55, drying and solidifying of liquid in the waste liquid discharge portion 55 can be reduced. For example, clogging of the waste liquid discharge portion 55 due to drying and solidifying of liquid can be reduced.

(10) In the configuration shown in FIGS. 8 and 9, the absorbent member 54 that can absorb liquid and moisture is disposed in the waste liquid container 50 such that at least part of the absorbent member 54 is not in contact with the bottom 51A of the container 51 between the first receiving portion 57A that receives liquid discharged from the waste liquid discharge portion 55 and the second receiving portion 57B that receives moisture discharged from the moisture discharge portion 56. Accordingly, liquid discharged from the waste liquid discharge portion 55 and moisture discharged from the moisture discharge portion 56 are mixed with each other via the communication portion 54A formed by a portion where at least part of the absorbent member 54 is not in contact with the bottom 51A. As a result, generation and deposition of a solid substance made of dried liquid in the receiving portions 57 and 57A can be reduced.

The above embodiments may be changed as described in the following modified examples. The configurations included in the above embodiments and the configurations included in the following modified examples may be combined in any way, or the configurations included in the following modified examples may be combined in any way.

- In the first embodiment, the humidity adjustment portion 60 may be disposed at a position spaced from the cassette 19 in the housing 11.
- The liquid ejecting apparatus 10 may not necessarily include the cassette 19. For example, the liquid ejecting apparatus may be configured such that the medium loaded on the feed tray disposed outside the housing 11 is fed into the housing 11. In this configuration as well, the inside of the housing 11 is adjusted at an appropriate humidity. Accordingly, curls of the medium S can be reduced in the housing 11.
- In FIG. 7, the receiving portion 57 in the waste liquid container 50 can be eliminated, and liquid and moisture from the introduction units 55 and 56 may be dripped on the top of the absorbent member 54. In this configuration as well, water discharged from the moisture discharge portion 56 is also attached to the waste liquid discharge portion 55. Accordingly, drying and solidifying of liquid in the waste liquid discharge portion 55 can be reduced.
- In FIGS. 8 and 9, at least part of the bottom 51A of the container 51 may be an inclined surface so that water in the second receiving portion 57B flows along the inclined surface toward the first receiving portion 57A. In this case, liquid in the first receiving portion 57A is easily mixed with moisture. Accordingly, deposition of a solid substance made of dried liquid in the first receiving portion 57A can be reduced.
- In FIGS. 8 and 9, the absorbent member 54 may be provided such that the entire bottom of the absorbent member 54 is not in contact with the bottom 51A of the container 51. For example, a stand is provided on part of the periphery on the bottom of the container 51, and the absorbent member 54 is placed on the stand. In this case, liquid can be mixed with water in the container 51 at a position where the absorbent member 54 is not in contact with the bottom 51A. In addition, if a relative distance between the bottom of the absorbent member 54 and the bottom 51A of the container 51 is reduced, the absorbent member 54 can absorb liquid and moisture.

The humidity sensor 65 may not be necessarily provided. The control unit 100 drives the humidity adjustment portion 60 when a power supply for the liquid ejecting apparatus 10 is on and when recovering from a power saving mode, and stops the driving of the humidity adjustment portion 60 when a predetermined time has elapsed after the start of driving or during a power saving mode. If usage in humid environment or dry environment is known, the inside of the housing 11 can be adjusted at an appropriate humidity by driving the humidity adjustment portion 60.

Cleaning is not limited to suctioning of liquid from the nozzles 12, and may also be performed by pressurizing liquid in the liquid supply source 14 to thereby discharging liquid from the nozzles 12, or by pressurizing liquid in the ejection head 13 to thereby discharging liquid from the nozzles 12.

In the configuration having a flushing box, the moisture flow path 31 may be connected to the waste liquid flow path 23 for discharging liquid (waste liquid) from the flushing box into the waste liquid container 50 at a position upstream relative to the suction pump 24.

In the case where the humidity adjustment portion 60 has the dehumidifying function and the humidifying function, the dehumidification portion and the humidification portion may be disposed at different positions. For example, the dehumidification portion is disposed at a position where it can directly dehumidify inside the cassette 19, and the humidification portion is disposed at a position where it can humidify another space in the housing 11 which communicates with the cassette 19. According to this configuration, when the humidification portion is configured to generate fine water droplets, fine water droplets generated by humidification are prevented from wetting a specific position of the media in the cassette 19 (for example, the uppermost medium), and air with an appropriate humidity in which fine water droplets are evaporated can be supplied into the cassette 19.

The liquid ejecting apparatus 10 is not limited to a line recording type, and may also be a serial recording type that performs recording while the ejection head moves in the scan direction perpendicular to the transport direction Y of the medium S or a lateral type in which the ejection head is movable in two directions, which are a main scan direction and a sub-scan direction.

The medium S is not limited to a cut-sheet that can be accommodated in the cassette 19, and may also be a medium having a long length such as a roll paper. The medium having a long length can also reduce curls of the medium before printing when a supply-side roll on which the medium having a long length is wound is housed in the housing 11. Further, in a configuration in which the supply-side roll is disposed outside the housing, curls of the medium can be reduced in the housing in which the medium is supplied.

The medium S is not limited to a paper sheet, and may also be a sheet or film made of synthetic resin or a fabric. For example, the medium S may be a plastic film or a thin plate, or a cloth used in a fabric printing apparatus. Further, even if the medium is made of a synthetic resin, creases and curls of the medium S can also be reduced by humidity adjustment as long as it is water-based.

The liquid ejecting apparatus 10 may also be an industrial apparatus that produces part of electronic components by using a printing technology (ink jet technology). For example, the ejection head 13 may also be used for production of liquid crystal displays, EL (electroluminescence) displays, and surface emission displays, and may form electrode materials or color materials (pixel materials) by ejection of liquid. Moreover, the liquid ejecting apparatus 10 may also be a three-dimensional ink jet printer that produces a three-dimensional model by ejecting liquid such as resin liquid. Creases and curls of a base sheet for the three-dimensional model (an example of the medium) can be reduced by humidity adjustment.

Technical ideas and their advantageous effects according to the aforementioned embodiments and modified examples will now be described.

Idea 1

A liquid ejecting apparatus including:

an ejection portion that ejects liquid onto a medium;

a waste liquid container having a container that is configured to store a waste liquid discharged from the ejection portion;

a housing that houses the ejection portion; and a humidity adjustment portion that adjusts humidity inside the housing, wherein the waste liquid container is configured to store moisture discharged from the humidity adjustment portion.

With this configuration, humidity adjustment inside the housing and a decrease of disadvantages caused by drying of liquid discharged from the ejection portion and received in the waste liquid container can be achieved with a simple configuration.

Idea 2

The liquid ejecting apparatus according to the idea 1, further including an accommodating portion that accommodates the medium, wherein the humidity adjustment portion adjusts humidity inside the accommodating portion.

With this configuration, since humidity inside the accommodating portion for the medium can be adjusted, curls of the medium can be effectively reduced.

Idea 3

The liquid ejecting apparatus according to the idea 1 or 2, further comprising:

a waste liquid flow path through which the waste liquid discharged from the ejection portion flows, a moisture flow path through which the moisture discharged from the humidity adjustment portion flows, and the moisture discharged from the humidity adjustment portion is stored in the waste liquid container via the moisture flow path and the waste liquid flow path.

With this configuration, the moisture is stored in the waste liquid container via the moisture flow path and the waste liquid flow path. Accordingly, since the moisture flows through the waste liquid flow path after it flows through the moisture flow path, liquid left in the waste liquid flow path is mixed with the moisture. Accordingly, liquid can be prevented from being dried and solidified in the waste liquid flow path.

Idea 4

The liquid ejecting apparatus according to the idea 3, further comprising an open-close valve that opens and closes the moisture flow path.

With this configuration, the open-close valve is opened to allow moisture from the humidity adjustment portion to be discharged into the waste liquid container via the moisture flow path and the waste liquid flow path. Further, the open-close valve is closed to restrict liquid from flowing into the humidity adjustment portion in the process of discharging liquid into the waste liquid container via the waste liquid flow path.

Idea 5

The liquid ejecting apparatus according to the idea 1 or 2, further comprising:

a waste liquid discharge portion that discharges the waste liquid into the waste liquid container; and a moisture discharge portion that discharges the moisture into the waste liquid container, wherein the waste liquid container includes an absorbent member capable of absorbing the waste liquid and the moisture, and the absorbent member is provided such that at least part of the absorbent member is not in contact with the bottom between a first receiving portion that receives the liquid discharged from the waste liquid discharge portion and a second receiving portion that receives the moisture discharged from the moisture discharge portion.

With this configuration, liquid discharged from the waste liquid discharge portion and moisture discharged from the moisture discharge portion are mixed with each other via a space (communication portion) formed at a position where at least part of the absorbent member is not in contact with the bottom of the container. Accordingly, deposition of a dried solid substance made of dried liquid in the portion for receiving liquid can be reduced.

Idea 6

The liquid ejecting apparatus according to the idea 1 or 2, further comprising:

a waste liquid discharge portion that discharges the waste liquid into the waste liquid container; and a moisture discharge portion that discharges the moisture into the waste liquid container, wherein the moisture discharge portion is provided vertically above the waste liquid discharge portion.

With this configuration, moisture discharged from the moisture discharge portion is also attached to the waste liquid discharge portion. Accordingly, clogging due to drying of the remaining liquid in the waste liquid discharge portion can be reduced.

Idea 7

The liquid ejecting apparatus according to the idea 6, wherein the waste liquid container includes a receiving portion that receives the waste liquid discharged from the waste liquid discharge portion, and the receiving portion also receives the moisture discharged from the moisture discharge portion.

With this configuration, since water is discharged onto the liquid discharged from the waste liquid discharge portion, deposition of a solid substance made of dried liquid in the container can be reduced.

Idea 8

The liquid ejecting apparatus according to the idea 1 or 2, further comprising:

a waste liquid flow path through which the waste liquid discharged from the ejection portion flows, a moisture flow path through which the moisture discharged from the humidity adjustment portion flows.

With this configuration, the waste liquid and the moisture can flow to a predetermined place.

Idea 9

The liquid ejecting apparatus according to the idea 8, wherein a part of the moisture flow path is constituted by the waste liquid flow path.

With this configuration, since the moisture flows through the waste liquid flow path and the moisture flow path, liquid left in the waste liquid flow path is mixed with the moisture. Accordingly, liquid can be prevented from being dried and solidified in the waste liquid flow path.

Idea 10

The liquid ejecting apparatus according to the idea 8, wherein the waste liquid flow path includes a waste liquid discharge portion for discharging the waste liquid into the waste liquid container, the moisture flow path includes a moisture discharge portion for discharging the moisture into the waste liquid container.

With this configuration, the waste liquid container can accommodate the waste liquid and the moisture.

Idea 11

The liquid ejecting apparatus according to the idea 10, wherein the moisture discharge portion is provided vertically above the waste liquid discharge portion.

With this configuration, the moisture discharged from the moisture discharge portion is also attached to the waste liquid discharge portion. Accordingly, clogging due to drying of the remaining liquid in the waste liquid discharge portion can be reduced.

Idea 12

A liquid ejecting apparatus comprising:

an ejection portion that ejects liquid onto a medium;

an installation portion in which a waste liquid container for storing the waste liquid discharged from the ejection portion is installed;

a housing that houses the ejection portion; and a humidity adjustment portion that adjusts humidity inside the housing, wherein in a state where the waste liquid container is installed in the installation portion, the moisture discharged from the humidity adjustment portion is stored in the waste liquid container.

With this configuration, humidity adjustment inside the housing and a decrease of disadvantages caused by drying of liquid discharged from the ejection portion and received in the waste liquid container can be achieved with a simple configuration.

Idea 13

The liquid ejecting apparatus according to the idea 12, further comprising:

a waste liquid flow path through which the waste liquid discharged from the ejection portion flows, a moisture flow path through which the moisture discharged from the humidity adjustment portion flows.

With this configuration, the waste liquid and the moisture can flow to a predetermined place.

Idea 14

The liquid ejecting apparatus according to the idea 13, wherein a part of the moisture flow path is constituted by the waste liquid flow path.

With this configuration, since the moisture flows through the waste liquid flow path and the moisture flow path, liquid left in the waste liquid flow path is mixed with the moisture. Accordingly, liquid can be prevented from being dried and solidified in the waste liquid flow path.

Idea 15

The liquid ejecting apparatus according to the idea 13, wherein the waste liquid flow path includes a waste liquid discharge portion for discharging the waste liquid into the waste liquid container, the moisture flow path includes a moisture discharge portion for discharging the moisture into the waste liquid container.

With this configuration, the waste liquid container can accommodate the waste liquid and the moisture.

Idea 16

The liquid ejecting apparatus according to the idea 15, wherein the moisture discharge portion is provided vertically above the waste liquid discharge portion.

With this configuration, the moisture discharged from the moisture discharge portion is also attached to the waste liquid discharge portion. Accordingly, clogging due to drying of the remaining liquid in the waste liquid discharge portion can be reduced.

The entire disclosure of Japanese Patent Application No. 2017-236662, filed Dec. 11, 2017 is expressly incorporated by reference herein.

What is claimed is:

1. A liquid ejecting apparatus comprising:

an ejection portion that ejects liquid onto a medium;

a waste liquid storing portion configured to store a waste liquid discharged from the ejection portion;

a housing that houses the ejection portion;

a humidity adjustment portion that adjusts humidity inside the housing; and an accommodating portion that accommodates the medium, wherein the humidity adjustment portion adjusts humidity inside the accommodating portion, and wherein the waste liquid storing portion is configured to store moisture discharged from the humidity adjustment portion.

2. The liquid ejecting apparatus according to claim 1, further comprising:

a waste liquid flow path through which the waste liquid discharged from the ejection portion flows; and a moisture flow path through which the moisture discharged from the humidity adjustment portion flows, wherein the moisture discharged from the humidity adjustment portion is stored in the waste liquid storing portion via the moisture flow path and the waste liquid flow path.

3. The liquid ejecting apparatus according to claim 2, further comprising an open-close valve that opens and closes the moisture flow path.

4. The liquid ejecting apparatus according to claim 1, further comprising:

a waste liquid discharge portion that discharges the waste liquid into the waste liquid storing portion; and a moisture discharge portion that discharges the moisture into the waste liquid storing portion, wherein the waste liquid storing portion includes an absorbent member capable of absorbing the waste liquid and the moisture, and the absorbent member is provided such that at least part of the absorbent member is not in contact with the bottom between a first receiving portion that receives the waste liquid discharged from the waste liquid discharge portion and a second receiving portion that receives the moisture discharged from the moisture discharge portion.

5. The liquid ejecting apparatus according to claim 1, further comprising:

a waste liquid discharge portion that discharges the waste liquid into the waste liquid storing portion; and a moisture discharge portion that discharges the moisture into the waste liquid storing portion, wherein the moisture discharge portion is provided vertically above the waste liquid discharge portion.

6. The liquid ejecting apparatus according to claim 5, wherein the waste liquid container includes a receiving portion that receives the waste liquid discharged from the waste liquid discharge portion, and the receiving portion also receives the moisture discharged from the moisture discharge portion.

7. The liquid ejecting apparatus according to claim 1, further comprising:

a waste liquid flow path through which the waste liquid discharged from the ejection portion flows, and a moisture flow path through which the moisture discharged from the humidity adjustment portion flows.

8. The liquid ejecting apparatus according to claim 7, wherein a part of the moisture flow path is constituted by the waste liquid flow path.

9. The liquid ejecting apparatus according to claim 7, wherein the waste liquid flow path includes a waste liquid discharge portion for discharging the waste liquid into the waste liquid storing portion, the moisture flow path includes a moisture discharge portion for discharging the moisture into the waste liquid container.

10. The liquid ejecting apparatus according to claim 9, wherein the moisture discharge portion is provided vertically above the waste liquid discharge portion.

11. A liquid ejecting apparatus comprising:

an ejection portion that ejects liquid onto a medium;

a waste liquid storing portion configured to store a waste liquid discharged from the ejection portion;

a housing that houses the ejection portion;

a humidity sensor that detects humidity inside the housing;

a humidity adjustment portion that adjusts humidity inside the housing; and a controller that controls the operation of the humidity adjustment portion based on a detected humidity by the humidity sensor, wherein the waste liquid storing portion is configured to store moisture discharged from the humidity adjustment portion.

12. The liquid ejecting apparatus according to claim 11, further comprising:

a waste liquid flow path through which the waste liquid discharged from the ejection portion flows, a moisture flow path through which the moisture discharged from the humidity adjustment portion flows.

13. The liquid ejecting apparatus according to claim 12, wherein a part of the moisture flow path is constituted by the waste liquid flow path.

14. The liquid ejecting apparatus according to claim 12, wherein the waste liquid flow path includes a waste liquid discharge portion for discharging the waste liquid into the waste liquid storing portion, the moisture flow path includes a moisture discharge portion for discharging the moisture into the waste liquid storing portion.

15. The liquid ejecting apparatus according to claim 14, wherein the moisture discharge portion is provided vertically above the waste liquid discharge portion.

16. A liquid ejecting apparatus comprising:

an ejection portion that ejects liquid onto a medium;

a waste liquid storing portion configured to store a waste liquid discharged from the ejection portion;

an accommodating portion that accommodates the medium; and a dehumidifying portion configured to dehumidify inside the accommodating portion, wherein the waste liquid storing portion is configured to store moisture discharged from the dehumidifying portion.

17. The liquid ejecting apparatus according to claim 16, further comprising:

a waste liquid flow path through which the waste liquid discharged from the ejection portion flows, a moisture flow path through which the moisture discharged from the dehumidifying portion flows.

18. The liquid ejecting apparatus according to claim 17, wherein the moisture discharged from the humidity adjustment portion is stored in the waste liquid storing portion via the moisture flow path and the waste liquid flow path.

19. The liquid ejecting apparatus according to claim 18, further comprising an open-close valve that opens and closes the moisture flow path.

* * * * *